US005199650A

United States Patent [19]

Ishibashi et al.

[11] Patent Number: 5,199,650

[45] Date of Patent: Apr. 6, 1993

[54] STRUCTURE FOR PREVENTING CURRENT FROM LEAKING OUT OF DEVICES FOR ELECTROSTATIC SPRAY COATING

[75] Inventors: Ichirou Ishibashi; Niichi Toyama; Toshio Kubota; Shoko Sasaki; Nobunari Arai, all of Sayama, Japan

[73] Assignee: Honda Giken Kogyo Kabushiki Kaisha, Tokyo, Japan

[21] Appl. No.: 821,048

[22] Filed: Jan. 16, 1992

[30] Foreign Application Priority Data

Jan. 22, 1991 [JP] Japan ..... 3-5709
Mar. 28, 1991 [JP] Japan ..... 3-64918

[51] Int. Cl.[5] ..... B05B 5/00

[52] U.S. Cl. ..... 239/691; 239/690; 361/228

[58] Field of Search ..... 239/690, 691, 317; 361/227, 228

[56] References Cited

U.S. PATENT DOCUMENTS 3,599,038 8/1971 Skidmore ..... 361/228
3,770,205 11/1973 Proctor et al. ..... 239/317
3,971,337 7/1976 Hastings .

FOREIGN PATENT DOCUMENTS 0125589 11/1984 European Pat. Off. .
2-2885 1/1°90 Japan .
1325266 8/1973 United Kingdom .

OTHER PUBLICATIONS

"Electrostatic Spraying with Conductive Liquids", NTIS Tech. Notes, No. DEC, 1989, Springfield, Va., p. 1042, NASA, Lyndon B. Johnson Space Center.

*Primary Examiner*—Andres Kashnikow
*Assistant Examiner*—Lesley D. Morris

[57] ABSTRACT

Disclosed herein is a structure for preventing current from leaking out of devices such as a valve, an intermediate reservoir, etc., which are employed in an electrostatic spray coating apparatus for applying a desired voltage to electrically conductive paint so as to electrostatically spray-coat a workpiece therewith. The current-leakage prevention structure basically comprises any one of the devices each made of an electrically-conductive material, a container made of an insulating material, which accommodates the device therein and has a paint passage defined therein capable of communicating with the device, and a cover for externally covering the container. A creepage distance defined by the container and the cover is set to reach a desired creepage length or more capable of preventing current leakage. It is therefore possible to reliably prevent current from leaking even when a high voltage is applied to the devices.

6 Claims, 6 Drawing Sheets

STRUCTURE FOR PREVENTING CURRENT FROM LEAKING OUT OF DEVICES FOR ELECTROSTATIC SPRAY COATING

BACKGROUND OF THE INVENTION

1. Field of the Invention

The present invention relates to a structure for preventing current from leaking out of devices such as a valve, an intermediate reservoir, etc., which are employed in an electrostatic spray coating apparatus for applying a desired voltage to electrically conductive paint so as to electrostatically spray-coat a workpiece therewith.

2. Description of the Related Art

As an electrostatic spray coating or painting apparatus for applying a high voltage to electrically conductive paint so as to electrostatically spray-coat an object such as a car body to be coated therewith, there has heretofore been known a paint color-changeover system disclosed in Japanese Patent Application Laid-Open No. 2-2885, for example.

According to the disclosure, the paint is first introduced into an intermediate reservoir electrically insulated from ground potential. Thereafter, the paint is supplied via a paint passage from the intermediate reservoir to a spray gun subjected to a high potential. Thus, a process for electrostatically spray-coating the object to be coated with the paint is carried out.

In the above disclosure, even the intermediate reservoir has been subjected to a considerable high voltage. It is therefore necessary to make devices such as the intermediate reservoir, various valves of insulating materials. However, the devices made of the insulating materials has problems in accuracy and strength, and the manufacturing cost is raised.

Further, a line is coupled to the devices through a joint. Thus, current tends to leak from the joint. When an electric conductor such as a human body approaches one of the devices, an electric discharge takes place due to insulation breakdown.

Therefore, there has been made the following approach. For example, a block valve mechanism disposed between a paint feed source and an intermediate reservoir, the intermediate reservoir, and a flow control valve for controlling the delivery rate of electrically conductive paint supplied to a spray gun from the intermediate reservoir are spaced away from one another by a distance required to reliably provide insulation against a high voltage applied to the paint. Under this condition, they are disposed on the same plane.

In the disclosure referred to above, however, the devices such as the block valve mechanism, the intermediate reservoir and the flow control valve are spaced away from one another by the distance referred to above. Therefore, spaces for disposing the devices are greatly increased. Further, since the devices are exposed to the outside, there is much risk of an electrical short when a robot arm approaches the devices, for example.

As a result, the devices cannot be disposed within a spray booth or near an electric conductor. In addition, the length of the line extending up to the spray gun increases. Therefore, paint is wasted in quantity when a color changeover process is performed. Further, much cleaning time is required and the quantity of cleaning liquid to be used is increased.

SUMMARY OF THE INVENTION

It is a principal object of the present invention to provide a current-leakage prevention structure suitable for use in devices such as a valve, an intermediate reservoir which are used for electrostatic spray coating, of a type wherein current can reliably be prevented from leaking out of the devices, and spaces for disposing the devices can be reduced thereby to enable a line coupled to the devices to be shortened with ease, and to provide a holding device used for the current-leakage prevention structure.

It is another object of the present invention to provide a structure for preventing current from leaking out of devices used for electrostatic spray coating, the structure comprising any one of the devices made of electrically-conductive materials and including a valve, an intermediate reservoir, etc., the devices being employed in an electrostatic spray coating apparatus for applying a desired voltage to electrically conductive paint so as to electrostatically spray-coat a work therewith, a container made of an insulating material, the container being used to accommodate the one device therein and having a paint passage defined therein capable of communicating with the one device, and a cover for externally covering the container, whereby a creepage distance defined by the container and the cover is set to reach a desired creepage length or more capable of preventing current leakage.

It is a further object of the present invention to provide a current-leakage prevention structure wherein the creepage distance is defined by an outer peripheral surface of the container and an inner peripheral surface of the cover, which is held in contact with the outer peripheral surface thereof.

It is a still further object of the present invention to provide a structure for preventing current from leaking out of devices used for electrostatic spray coating, the structure comprising any one of the devices made of electrically-conductive materials and including a valve, an intermediate reservoir, etc., the devices being employed in an electrostatic spray coating apparatus for applying a desired voltage to electrically conductive paint so as to electrostatically spray-coat a workpiece therewith, a container made of an insulating material, the container being used to accommodate the one device therein and having a paint passage defined therein capable of communicating with the one device, a cover for externally covering the container, and an insulating seal disposed between the container and the cover, whereby a creepage distance defined by the container and the cover is set to reach a desired creepage length or less capable of preventing current leakage.

It is a still further object of the present invention to provide a structure for preventing current from leaking out of devices used for electrostatic spray coating, the structure comprising a manifold base made of an electrically-insulating material, the manifold base having a line connecting portion which enables a plurality of lines to be externally connected, a storage tank formed integrally with the manifold base, for temporarily storing electrically conductive paint therein, an insulation mechanism for electrically insulating the storage tank from a paint feed source, and a pair of covers each made of an electrically-insulating material, the covers serving to cover devices including the insulation mechanism and being mounted on the manifold base.

It is a still further object of the present invention to provide a current-leakage prevention structure wherein a creepage distance defined by the manifold base and the covers is set to a desired creepage length or more capable of preventing current leakage.

It is a still further object of the present invention to provide a current-leakage prevention structure wherein a flow control valve for controlling the delivery rate of the paint when the paint stored in the storage tank is supplied to a spray gun is disposed in an end of the storage tank.

It is a still further object of the present invention to provide a current-leakage prevention structure further including a detecting rod which is mounted on a piston reciprocatively movable within the storage tank and which upwardly extends outwardly of the storage tank, and detecting means having valves incorporated therein for engaging the detecting rod so as to obtain positional information about the piston.

The above and other objects, features and advantages of the present invention will become apparent from the following description and the appended claims, taken in conjunction with the accompanying drawings in which preferred embodiments of the present invention are shown by way of illustrative example.

DETAILED DESCRIPTION OF THE PREFERRED EMBODIMENTS

Figure 2:
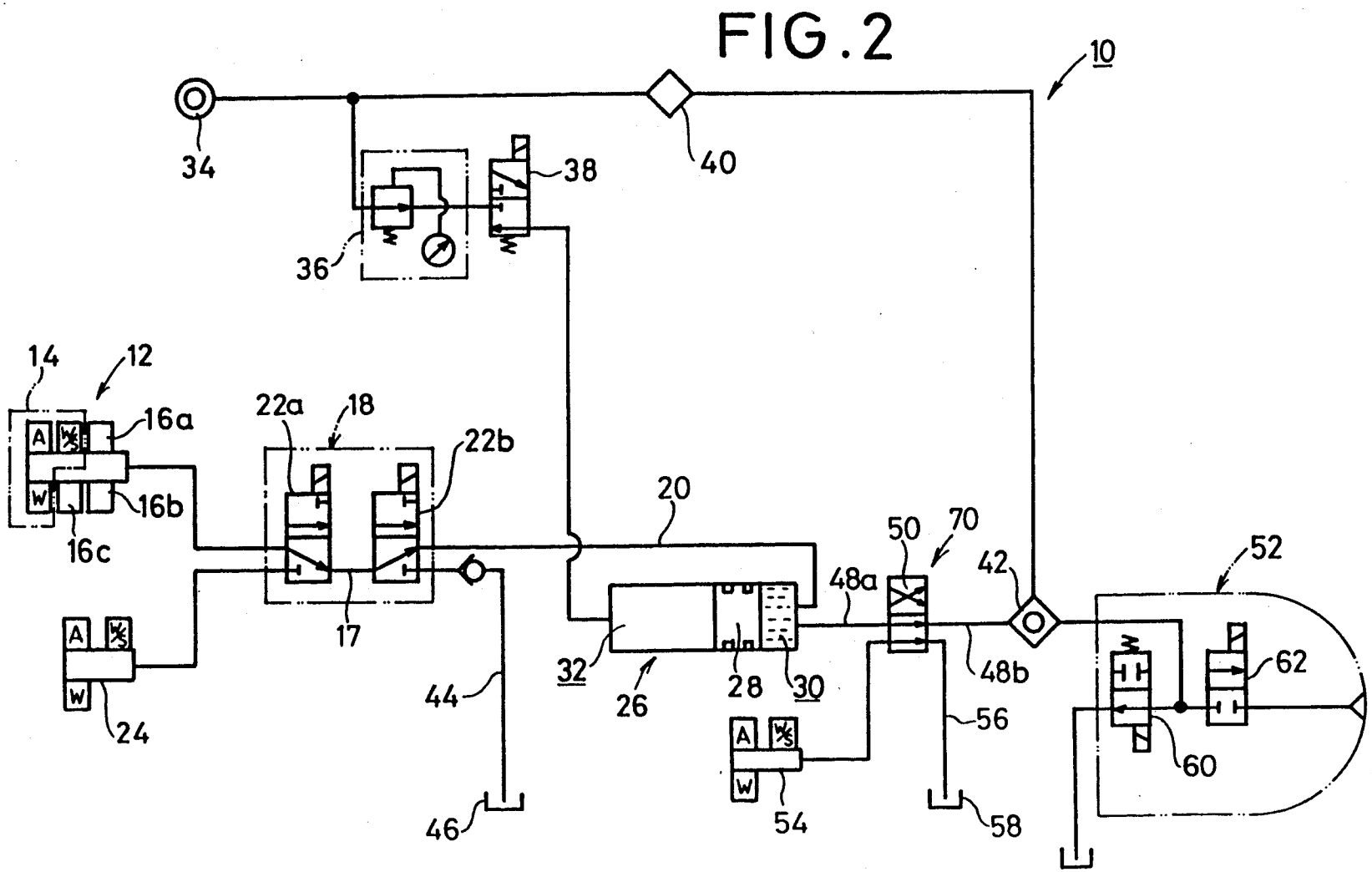
FIG. 2 is a view schematically illustrating an electrostatic spray coating apparatus incorporating the current-leakage prevention structure therein.

Referring to FIG. 2, numeral 10 indicates an electrostatic spray coating apparatus incorporating a current-leakage prevention mechanism or structure according to a first embodiment, which can prevent current from leaking out of devices for electrostatic spray coating. The electrostatic spray coating apparatus 10 has a color changeover valve mechanism 12, which comprises a first flush valve 14 for controlling the supply of air (A), water (W), cleaning liquid (S), etc., and a plurality of paint valves 16*a* through 16*c* capable of supplying different paints. Coupled to the color changeover valve mechanism 12 is a feed line 20 having an electrical insulating line 17 and a block valve mechanism 18 including the line 17, which are disposed in at least a part thereof.

The block valve mechanism 18 has two changeover valves 22*a*, 22*b*. The block valve mechanism 18 is actuated to cause the changeover valve 22*a* on the side of an inlet thereof to select either one of the color changeover valve mechanism 12 and a second flush valve 24 for controlling the supply of air (A), water (W), cleaning liquid (S), etc. Thus, the block valve mechanism 18 communicates with an intermediate reservoir 26 by the feed line 20. The intermediate reservoir 26 comprises a first cylinder chamber 30 compartmented by a piston 28 and used for the injection of paint and clearing or washing liquid, and a second cylinder chamber 32 for the supply of air. An air feed source 34 communicates with the second cylinder chamber 32 through a flow control valve 36 and an on-off valve 38. The air feed source 34 is coupled via a booster 40 to a paint flow control device 42 for controlling the pressure of air. The paint flow control device 42 serves to control the delivery rate of paint. The changeover valve 22*b* is coupled to a waste-liquid tank 46 through a discharge line 44.

A four-way changeover valve 50 made of an electrically-conductive material is connected via a delivery line 48*a* to the first cylinder chamber 30 of the intermediate reservoir 26. In addition, the four-way changeover valve 50 is coupled to a spray gun 52 from the paint flow control device 42 through a delivery line 48*b*. A third flush valve 54 for controlling the supply of air (A), water (W), cleaning liquid (S), etc. is coupled to the four-way changeover valve 50, whereas a waste-liquid tank 58 is connected via a discharge line 56 to the four-way changeover valve 50. The spray gun 52 has a dump valve 60 and a trigger valve 62, and is coupled to an unillustrated high-voltage applying means.

A current-leakage prevention structure 70 according to the present embodiment is mounted on the four-way changeover valve 50 employed in the electrostatic spray coating apparatus 10 constructed as described above.

Figure 1:
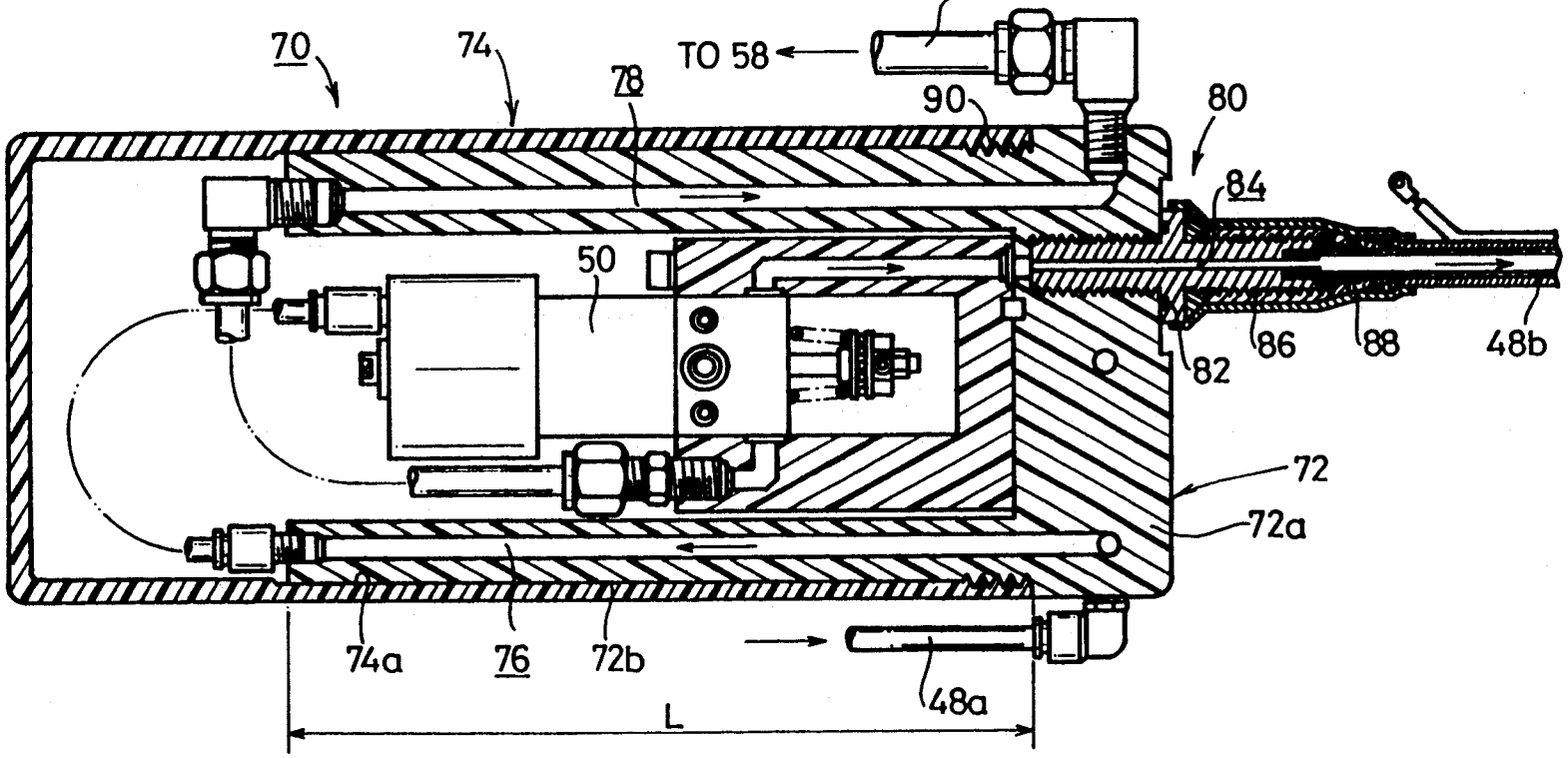
FIG. 1 is a vertical cross-sectional view showing a current-leakage prevention structure according to a first embodiment of the present invention, which prevents current from leaking out of devices for electrostatic spray coating.

As shown in FIG. 1, the current-leakage prevention structure 70 comprises the four-way changeover valve 50, a container 72 made of an insulating material, for accommodating the four-way changeover valve 50 therein, and a cover 74 for externally covering the container 72. The container 72 is made of a resinous material such as polyacetal, and has a first passage (not shown) defined therein for causing the delivery line 48*a* to communicate with the four-way changeover valve 50 and a second passage 78 defined therein for causing the four-way changeover valve 50 to communicate with the discharge line 56. A connecting means 80 for coupling the four-way changeover valve 50 to the delivery line 48*b* is fixedly mounted on a side wall 72*a* of the container 72. The connecting means 80 comprises a jointing member 82 threaded onto the side wall 72*a*, a nut 86 for connecting the delivery line 48*b* to the jointing member 82 so as to cause the delivery line 48*b* to communicate with a passage 84 defined in the jointing member 82, and a pipe 88 for covering the jointing member 82 and the nut 86.

The cover 74 is composed of a resinous material such as polyacetal, and shaped substantially in the form of a cylinder whose one end is closed. The cover 74 is fixed to the container 72 by a screw thread portion 90. A creepage distance or length L of a portion at which an inner peripheral surface 74*a* of the cover 74 is directly brought into contact with an outer peripheral surface 72b of the container 72, is selected so as to reach a desired creepage length or greater capable of preventing current leakage, i.e., an undesired flow of electricity. Described specifically, when a voltage of −60 kV is applied to paint, a creepage distance L of 200 mm or greater is selected. A description will now be made of an insertion portion, for example. The term of "creepage length" represents the distance (hereinafter used as "creepage length or distance") of the insertion portion, which extends in the longitudinal direction of the insertion portion along a cross-sectional form thereof. Described specifically, the creepage length corresponds to the sum of the length of the screw thread portion 90, which extends in the axial direction thereof along a cross-sectional form thereof and the axial length of the portion at which the inner peripheral surface 74a is brought into contact with the outer peripheral surface 72b. The container 72 has a passage 76 defined therein for supplying drive air used to carry out the switching action of the four-way changeover valve 50. An end of the passage 76 communicates with an air feed path or passage (not shown).

The operation of the current-leakage prevention structure 70 constructed as described above will now be described below.

When it is desired to electrostatically spraycoat an object or work with electrically conductive paint using the electrostatic spray coating apparatus 10, paint of a predetermined color is first fed under pressure from a paint valve 16a of the color changeover valve mechanism 12 as shown in FIG. 2 in such a manner that the first cylinder chamber 30 of the intermediate reservoir 26 is charged therewith through the feed line 20. Further, the paint is supplied to the spray gun 52 by the delivery line 48a, the four-way changeover valve 50 and the delivery line 48b in that order until the spray gun 52 is fully charged therewith. Upon charging of the spray gun 52 with the paint, the trigger valve 62 is closed and the dump valve 60 is opened. After completion of the charging of the spray gun 52 with the paint, the dump valve 60 is closed.

When the switching action of the changeover valves 22a, 22b of the block valve mechanism 18 is carried out, the second flush valve 24 is actuated to wash or clean the block valve mechanism 18. Thereafter, cleaning liquid used for the cleaning of the block valve mechanism 18 is discharged into the waste-liquid tank 46 through the discharge line 44. Then, the block valve mechanism 18 is dried, so that the color changeover valve mechanism 12 is electrically insulated from the intermediate reservoir 26.

Then, drive air is supplied from the air feed source 34 to the second cylinder chamber 32 of the intermediate reservoir 26 by the flow control valve 36 and the on-off valve 38 so as to displace the piston 28 toward the first cylinder chamber 30. As a result, the paint is applied to an unillustrated work under the on-action of the trigger valve 62 in a state in which a high voltage is being applied to the paint.

In the present embodiment, the four-way changeover valve 50 is made of the electrically-conductive material. It is therefore possible to suitably ensure the strength of the four-way changeover valve 50 upon application of the high voltage to the paint. In addition, the four-way changeover valve 50 can highly accurately be operated and its manufacturing cost can be reduced, whereas current leakage and an electric discharge due to the insulation breakdown tend to occur. However, the container 72 accommodates the four-way changeover valve 50 therein and the container 72 is externally covered with the cover 74 made of an electrically-conductive material. In addition, the creepage distance L of the portion at which the container 72 is directly brought into contact with the cover 74 is selected to reach a desired creepage distance or greater (e.g., 200 mm or so upon application of −60 kV to paint) capable of preventing the current leakage. Thus, even when a high voltage is applied to the four-way changeover valve 50, an electric discharge caused by the current leakage is no longer developed, and an electrostatic spray coating process can efficiently be carried out while a desired voltage is being maintained.

In addition, the provision of the current-leakage prevention structure 70 makes it unnecessary to apply a special structure for the prevention of the current leakage to the connecting means 80 coupled to the container 72. The manufacturing cost of the connecting means 80 can greatly be reduced.

Even if an electric conductor such as a robot arm approaches the four-way changeover valve 50, any electric discharge is not produced from the four-way changeover valve 50. Therefore, the four-way changeover valve 50 can be disposed in a position near the electric conductor or in a spray booth. As a result, the length of each of the delivery lines 48a, 48b, which extend between the intermediate reservoir 26 and the spray gun 52, can greatly be reduced, and wasteful paint discharged when a paint changeover process is made in particular can be reduced at a time. In addition, the cleaning time and the quantity of the cleaning liquid to be used can be reduced.

Figure 3:
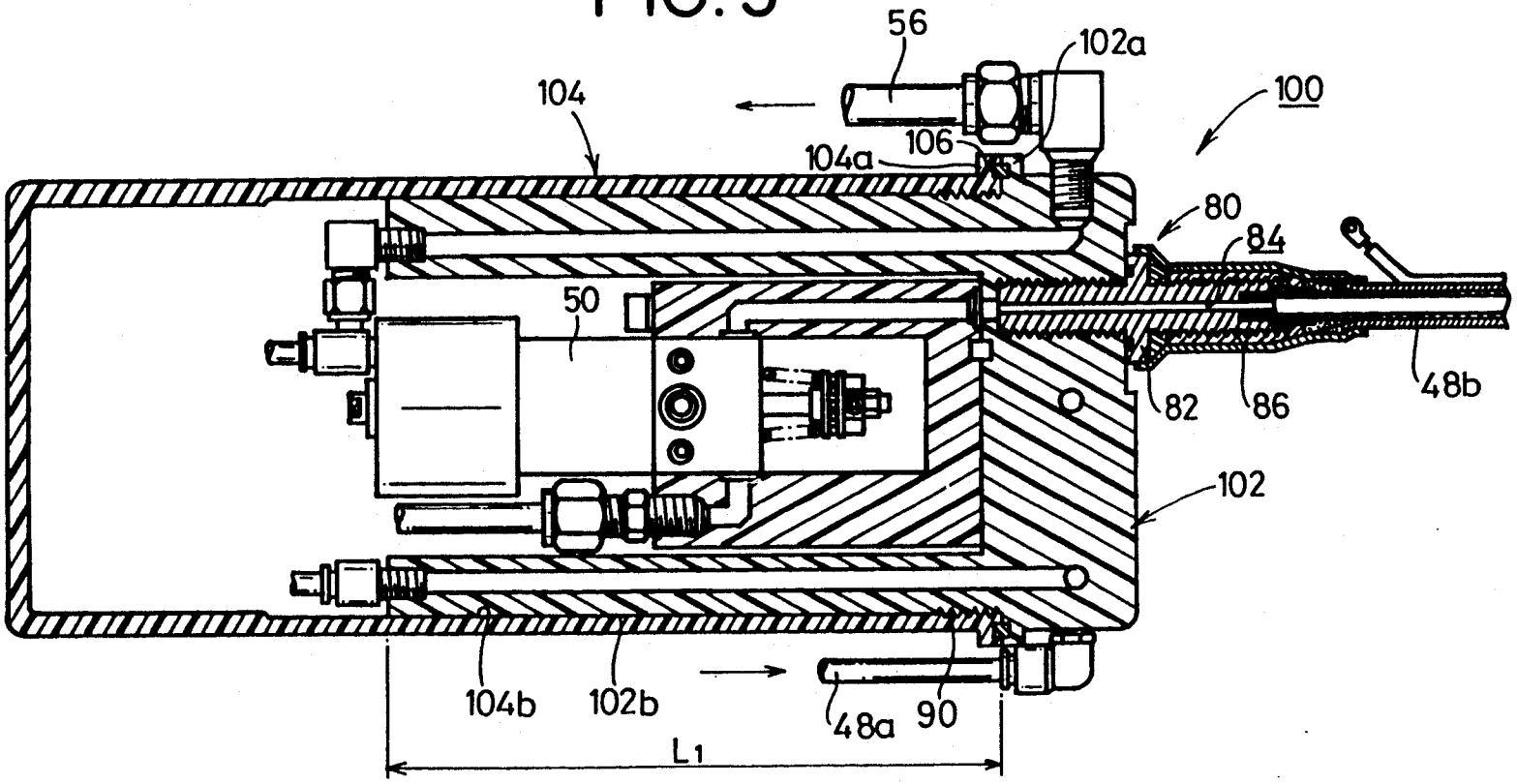
FIG. 3 is a vertical cross-sectional view depicting a current-leakage prevention structure according to a second embodiment of the present invention, which prevents current from leaking out of devices for electrostatic spray coating.

A current-leakage prevention structure according to a second embodiment of the present invention, which can prevent current from leaking out of devices for electrostatic spray coating, will now be described below with reference to FIG. 3. Incidentally, the same reference numerals as those employed in the current-leakage prevention structure 70 according to the first embodiment denote the same elements of structure as those in the current-leakage prevention structure 70, and will not be described in detail.

A current-leakage prevention structure according to the second embodiment, which is designated at numeral 100, basically comprises a container 102, a cover 104, flanges 102a, 104a disposed in a portion at which the container 102 and the cover 104 are joined to each other, and an insulating seal 106 disposed between the flanges 102a and 104a. In this case, a creepage distance $L_1$ of a portion at which an inner peripheral surface 104b of the cover 104 is directly brought into contact with an outer peripheral surface 102b of the container 102 is selected to reach a desired creepage distance or below capable of preventing an undesired flow of electricity.

According to the second embodiment, since the seal 106 is disposed in an end of a creepage surface at which the cover 104 and the container 102 are directly brought into contact with each other, the creepage distance $L_1$ can further be reduced. Described specifically, when a seal 106 made of a tetrafluoroethylene resin is used, for example upon application of a voltage of −60 kV to paint, the insulation breakdown voltage of the seal 106 is 20 kV/mm or so. Therefore, the seal 106 having a surface thickness of 2 mm can provide protection against a voltage of 40 kV. It is thus simply necessary to ensure a creepage distance set to such an extent that the seal 106 can provide protection against the remaining voltage of 20 kV. A creepage distance of 50 mm or so may practically be ensured. This means that the creepage distance can be reduced to ¼ or so as compared with a case in which the creepage distance is 200 mm or so when the seal 106 is not provided.

Incidentally, the present embodiment describes a case in which the current-leakage prevention structure 70 is applied to the four-way changeover valve 50. However, the present invention is not necessarily limited to the present embodiment. The current-leakage prevention structure 70 can also be applied to the intermediate reservoir 26 or other various valves, for example.

A description will now be made below of a current-leakage prevention structure according to a third embodiment of the present invention, which can prevent current from leaking out of devices for electrostatic spray coating, and a holding device used for the structure, with reference to the accompanying drawings.

Figure 4:
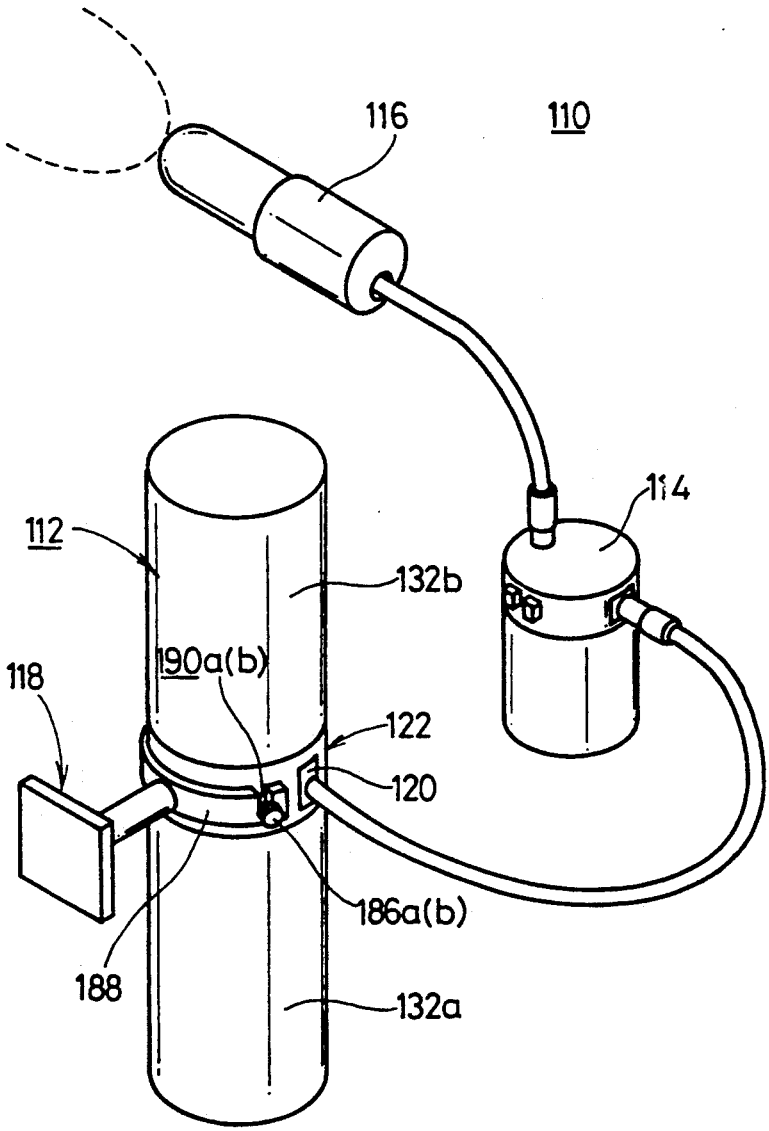
FIG. 4 is a schematic perspective view showing an electrostatic spray coating apparatus and a holding device, the apparatus incorporating therein an intermediate reservoir which adopts a current-leakage prevention structure according to a third embodiment of the present invention, which prevents current from leaking out of devices for electrostatic spray coating.

Referring now to FIG. 4, numeral 110 indicates an electrostatic spray coating apparatus. The electrostatic spray coating apparatus 110 comprises an intermediate reservoir 112 which adopts the current-leakage prevention structure according to the third embodiment and to which an unillustrated color changeover valve mechanism or the like is coupled, a spray gun 116 coupled to the intermediate reservoir 112 by a four-way changeover valve 114, and a holding device 118 to which the intermediate reservoir 112 is vertically fixed.

Figure 5:
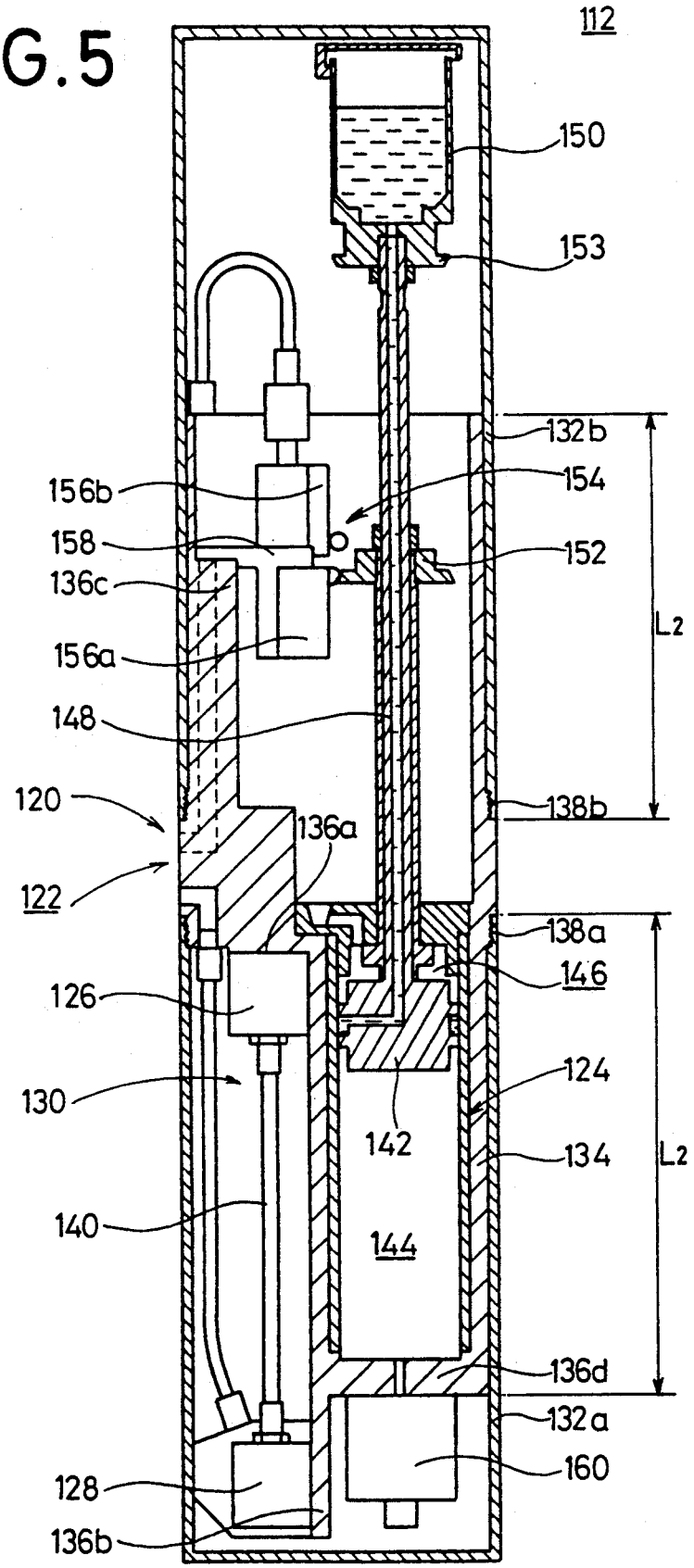
FIG. 5 is a vertical cross-sectional view showing the current-leakage prevention structure shown in FIG. 4.

As shown in FIG. 5, the intermediate reservoir 112 comprises a manifold base (member made of an electrically-insulating material) 122 which has a line connecting portion, i.e., a line jointer 120 enabling a plurality of lines to be externally connected and which is made of an electrically-insulating material, a storage tank 124 formed integrally with the manifold base 122, for temporarily storing electrically conductive paint therein, an insulation mechanism 130 having a pair of three-way changeover valves 126, 128 spaced a given distance away from each other and disposed along the storage tank 124, and covers 132*a*, 132*b* each made of an electrically-insulating material, which are mounted on the manifold base 122 in such a manner as to cover devices including the insulation mechanism 130.

The manifold base 122 basically comprises the line jointer 120 to be described later, an outer wall portion 134 of the storage tank 124 and portions 136*a* through 136*d* for mounting devices, all of which are formed in a single unit, and screw thread portions 138*a*, 138*b* respectively defined in opposite ends of the line jointer 120, for fixing the covers 132*a*, 132*b*. The three-way changeover valves 126, 128 of the insulation mechanism 130 are fixed to the mounting portions 136*a*, 136*b* respectively. In addition, an insulating pipe or line 140 having a length capable of providing insulation against a predetermined high voltage is disposed between the three-way changeover valves 126 and 128.

The storage tank 124 includes a first cylinder chamber 144 compartmented by a piston 142 and used for the injection of paint and cleaning liquid, and a second cylinder chamber 146 used for the supply of air. A a cylindrical detecting rod 148, which upwardly extends outwardly of the storage tank 124, is mounted on the piston 142. In addition, a tank 150 for storing cleaning fluid therein is mounted on the detecting rod 148. A dog 152 is fixedly disposed in a given position of the detecting rod 148. A tank 150 is provided with a dog 153, and the dogs 152, 153 are held in engagement with a detecting means 154.

The detecting means 154 has on-off valves 156*a*, 156*b* which respectively engage the dogs 152, 153 in such a manner as to be selectively operated. The on-off valves 156*a*, 156*b* are fixedly mounted on the mounting portion 136*c* of the manifold base 122 by a mounting member 158. A flow control valve 160, which communicates with the first cylinder chamber 144 of the storage tank 124 so as to control the delivery rate of paint, is fixed to the mounting portion 136*d* of the manifold base 122.

Figure 6:
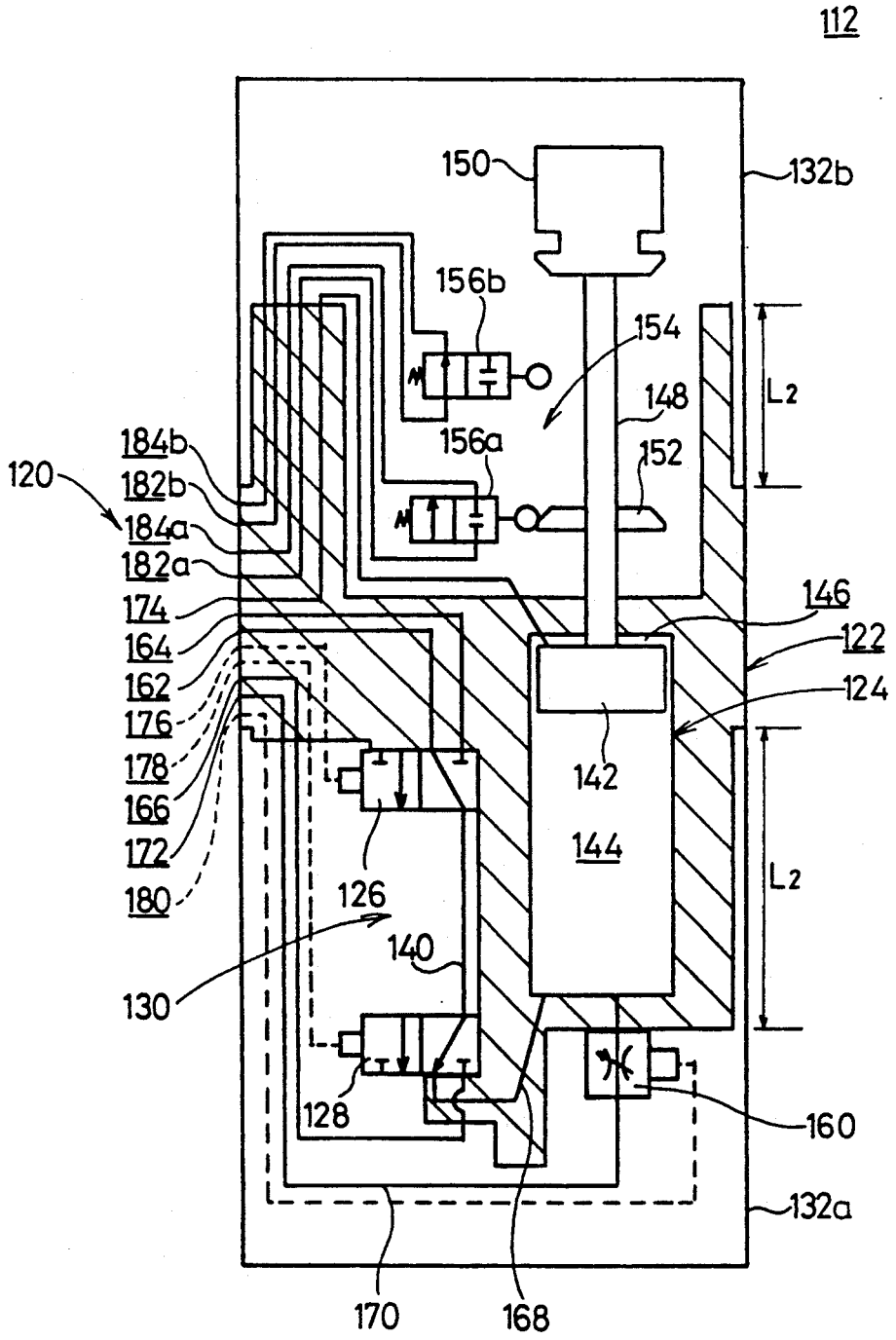
FIG. 6 is a vertical cross-sectional view for schematically describing a flow-channel system of the current-leakage prevention structure of FIG. 4.

A flow-channel system of the intermediate reservoir 112 will now be described below with reference to FIG. 6.

The line jointer 120 formed in one of the opposite ends of the manifold base 122 includes a paint inlet 162 and a cleaning liquid inlet 164 defined therein adjacent to each other. The paint inlet 162 and the cleaning liquid inlet 164 communicate with respectively corresponding ports of the three-way changeover valve 126. The three-way changeover valve 128, which communicates via the line 140 with the three-way changeover valve 126, is actuated to selectively communicate with a cleaning liquid outlet 166 opened at the line jointer 120 and a paint flow channel 168 opened for the first cylinder chamber 144 of the storage tank 124. A paint flow channel 170 communicates with the first cylinder chamber 144 through a flow control valve 160, and also communicates with a paint outlet 172 opened at the line jointer 120.

The line jointer 120 has a first drive air port 174 defined therein, for displacing the piston 142 toward the first cylinder chamber 144, and second through fourth drive air ports 176, 178, 180 defined therein, for actuating the three-way changeover valves 126, 128 and the flow control valve 160 respectively. In addition, the line jointer 120 also has air inlets 182*a*, 182*b* defined therein, for introducing air for detection into the on-off valves 156*a*, 156*b* respectively, and air outlets 184*a*, 184*b* defined therein, for discharging the air therefrom respectively.

In order to reliably insulate devices from one another and insulate the devices from the outside when a high voltage is directly applied to electrically conductive paint, the intermediate reservoir 112 has a creepage distance $L_2$ capable of effectively providing insulation against the high voltage applied to the paint, which has been ensured at a portion at which the covers 132*a*, 132*b* are connected to the manifold base 122.

As shown in FIG. 4, the holding device 118 has bolts 186*a*, 186*b* mounted on an outer wall portion of the intermediate reservoir 112, a frame 188 having the shape corresponding to the outer shape of the intermediate reservoir 112, and grooves 190*a*, 190*b* defined in the frame 188 and used to fit the bolts 186*a*, 186*b* therein so as to hold the intermediate reservoir 112 in an upright position. The frame 188 is fixed to a side wall (not shown) in a job site.

The operation of the intermediate reservoir 112 constructed as described above will now be described below.

First of all, the paint inlet 162 is held in communication with the unillustrated color changeover valve mechanism, and the cleaning liquid inlet 164 is held in communication with a flush valve. In addition, the cleaning liquid outlet 166 is connected to a waste-liquid tank. The paint outlet 172 communicates with the spray gun 116 through the four-way changeover valve 114, and the first to fourth drive air ports 174, 176, 178, 180 are held in communication with an air feed source. Further, the air inlet 182*a* and the air outlet 184*a*, and the air inlet 182*b* and the air outlet 184*b* are held in communication with detecting units respectively.

When paint of a predetermine color is fed under pressure to the paint inlet 162 from the color changeover valve mechanism upon execution of an electrostatic spray painting process by the electrostatic spray painting apparatus 110, the paint is supplied via the line 140 to the three-way changeover valve 128 from the three-way changeover valve 126. Thereafter, the paint is introduced into the first cylinder chamber 144 of the storage tank 124 through the paint flow channel 168. The paint with which the first cylinder chamber 144 has been charged is delivered from the paint flow channel 170 to the four-way changeover valve 114 via the paint outlet 172, after which the spray gun 116 is completely charged with the paint. At this time, the piston 142 is moved upward to cause the dog 152 to engage the on-off valve 156*a*, thereby enabling the detecting means 154 to automatically detect that the spray gun 116 has been charged with the paint.

Then, drive air is supplied to the second and third drive air ports 176, 178 from the air feed source, so that the switching operations of the three-way changeover valves 126, 128 of the insulation mechanism 130 are performed. Therefore, the cleaning liquid supplied from the flush valve successively passes through the cleaning liquid inlet 164, the three-way changeover valve 126, the line 140 and the three-way changeover valve 128, and is then discharged into the waste-liquid tank through the cleaning liquid outlet 166. Thus, the insulation mechanism 130 is dried, so that the color changeover valve mechanism and the intermediate reservoir 112 are electrically insulated from each other.

The drive air is now supplied to the first drive air port 174 from the air feed source so as to displace the piston 142 toward the first cylinder chamber 144. Thus, the delivery rate of the paint is controlled by the flow control valve 160, and thereafter desired paint is applied to an unillustrated work from the spray gun 116 in a state in which a high voltage has directly been applied to the paint. At this time, the piston 142 is displaced toward the first cylinder chamber 144, so that the dog 153 is held in engagement with the on-off valve 156*b*, thereby enabling the detecting means 154 to automatically detect information about the displacement of the piston 142 toward the first cylinder chamber 144.

In the present embodiment, the line jointer 120 is formed in one of the opposite ends of the manifold base 122, and the desired lines are coupled to the line jointer 120. Therefore, desired fluid can be supplied to the various devices fixed to the manifold base 122, i.e., the three-way changeover valves 126, 128, the flow control valve 160, the on-off valves 156*a*, 156*b* and the piston 142. It is thus possible to easily carry out a process for connecting such various devices with respectively corresponding pipes or lines.

Further, the mounting portions 136*a* through 136*d* are integrally mounted on the manifold base 122, and the various devices such as the three-way changeover valves 126, 128, the flow control valve 160 and the on-off valves 156*a*, 156*b* are fixed to the mounting portions 136*a* through 136*d*. Such various devices are covered with the covers 132*a*, 132*b* threaded onto the manifold base 122. In addition, the length of the insulating line 140 and the creepage distance $L_2$ are set in such a manner that the insulation against the high voltage applied to the paint can reliably be achieved. It is therefore possible to reliably insulate various devices from one another and from the outside. In addition, such devices can be accommodated in the intermediate reservoir 112 in a compacted manner, and the intermediate reservoirs 112 can be disposed adjacent to each other. A process for the maintenance of the various devices can be simplified at a time by detaching the covers 132*a*, 132*b* from the manifold base 122.

Furthermore, the intermediate reservoir 112 can reliably be held in an upright position by making use of the holding device 118 employed in the present embodiment. It is therefore possible to greatly reduce the intervals between a plurality of adjacent intermediate reservoirs 112 in particular.

Incidentally, the insulating line 140 may also be spaced away from the three-way changeover valve 128 by a length capable of providing insulation against the three-way changeover valve 128 after an actuator such as a cylinder, etc. has been coupled to the line 140 of the insulation mechanism 130 and a paint charging process has been completed.

The current-leakage prevention structure according to the present invention can bring about the following advantageous effects.

According to one effect of the present invention, since devices such as valves, an intermediate reservoir, etc. are made of electrically-conductive materials, desired accuracy and strength can be achieved. In addition, the devices are covered with a container made of an insulating material and covers, and a creepage distance defined by the container and the covers is set, i.e., selected to reach a desired creepage length or above capable of preventing current from leaking. It is therefore possible to reliably prevent current leakage from occurring even when a high voltage is applied to the devices. It is thus unnecessary to space the devices away from a spray booth or the like. In addition, paint paths or passages can be reduced to a minimum length, and paint, cleaning time and cleaning liquid, which are wasted when a color changeover process is performed, can be reduced at a time.

According to another effect of the present invention, even if a creepage distance defined by a container and covers has been selected to reach a desired creepage length or less capable of preventing current leakage, insulating seals can provide reliable insulation against a high voltage, thereby making it possible to effectively prevent an undesired flow of electricity produced upon application of the high voltage to paint.

According to a further effect of the present invention, lines for the supply of electrically conductive paint, a line used for drive air and a line used for cleaning liquid or the like are connected to a line connecting portion mounted on a manifold base made of an electrically-insulating material. In addition, devices such as a storage tank, an insulation mechanism, etc., which have been mounted on the manifold base, are covered with covers made of electrically-insulating materials. Therefore, such devices can be disposed in a compacted manner in a state in which they have reliably been electrically-insulated, and spaces for disposing these devices can effectively be used.

In a holding device employed in the present invention, bolts mounted on an outer wall portion of a member used to externally cover devices such as an intermediate reservoir, etc., are held in engagement with a frame so as to be held in place. As a result, a plurality of members can uprightly be disposed adjacent to one another in particular. In addition, an efficient use of the spaces for disposing the devices such as the intermediate reservoir, etc. can easily be achieved.

Having now fully described the invention, it will be apparent to those skilled in the art that many changes and modifications can be made without departing from the spirit or scope of the invention as set forth herein.

What is claimed is:

1. A structure for preventing current from leaking out of devices used for electrostatic spray coating, said structure comprising:

a manifold base made of an electrically-insulating material, said manifold base having a line connecting portion which enables a plurality of lines to be externally connected;

a storage tank formed integrally with said manifold base, for temporarily storing electrically conductive paint therein;

an insulation mechanism for electrically insulating said storage tank from a paint feed source; and a pair of covers each made of an electrically-insulating material, said covers serving to cover devices including said insulation mechanism and being mounted on said manifold base.

2. A structure according to claim 1, wherein a creepage distance defined by said manifold base and said covers is set to a desired creepage length or more capable of preventing current leakage.

3. A structure according to claim 1, wherein a flow control valve for controlling the delivery rate of the paint when the paint stored in said storage tank is supplied to a spray gun is disposed in an end of said storage tank.

4. A structure according to claim 1, further including a detecting rod which is mounted on a piston reciprocatively movable within said storage tank and which upwardly extends outwardly of said storage tank, and detecting means having valves incorporated therein for engaging said detecting rod so as to obtain positional information about said piston.

5. A structure for preventing electric current from leaking out of devices used in an electrostatic spray-coating apparatus in which a desired voltage is applied to electrically conductive paint for electrostatically spraying said paint to coat a workpiece, each of said devices comprising valves and reservoirs respectively of desired numbers, said valves and reservoirs made of electrically conductive materials, said structure comprising:

a container made of an insulating material for accommodating each of said devices therein, said container having a paint passage for providing operative communication between predetermined devices of each of said devices; and a cover for externally covering said container;

wherein a creepage distance is defined by an outer peripheral surface of said container and an inner peripheral surface of said cover which is held in contact with the outer peripheral surface of said container, said creepage distance being set to reach a desired creepage length or more capable of preventing said electric current from leaking.

6. A structure for preventing electric current from leaking out of devices used in an electrostatic spray coating apparatus in which a desired voltage is applied to electrically conductive paint for electrostatically spraying said paint to coat a workpiece, each of said devices comprising valves and reservoirs respectively of desired numbers, said valves and reservoirs made of electrically conductive materials, said structure comprising:

a container made of an insulating material for accommodating each of said devices therein, said container having a paint passage for providing operative communication between predetermined devices of each of said devices; and a cover for externally covering said container;

wherein a creepage distance is defined by an outer peripheral surface of said container and an inner peripheral surface of said cover which is held in contact with the outer peripheral surface of said container, said creepage distance being set to reach a desired creepage length or less capable of preventing said electric current from leaking.

* * * * *